US008717276B2

(12) United States Patent
Huang et al.

(10) Patent No.: US 8,717,276 B2
(45) Date of Patent: May 6, 2014

(54) DISPLAYING METHOD AND PORTABLE ELECTRONIC DEVICE USING THE SAME

(75) Inventors: Hsiao-Ming Huang, Taipei (TW); Yu-Ting Wang, Taipei (TW); Chia-Chi Ko, Taipei (TW); Heng-Yu Wu, Taipei (TW); Yu-Wen Chou, Taipei (TW); Pei-Yu Chen, Taipei (TW)

(73) Assignee: Pegatron Corporation, Taipei (TW)

( * ) Notice: Subject to any disclaimer, the term of this patent is extended or adjusted under 35 U.S.C. 154(b) by 325 days.

(21) Appl. No.: 13/236,848

(22) Filed: Sep. 20, 2011

(65) Prior Publication Data

US 2012/0074870 A1 Mar. 29, 2012

(30) Foreign Application Priority Data

Sep. 21, 2010 (TW) ..... 99132106 A

(51) Int. Cl.
*G09G 3/36* (2006.01)

(52) U.S. Cl.
USPC ..... 345/102

(58) Field of Classification Search
CPC ..... G09G 3/3406; G09G 2320/0646; G09G 2320/064; G09G 2340/0492
USPC ..... 345/102
See application file for complete search history.

(56) References Cited

U.S. PATENT DOCUMENTS

| | | | | |
|---|---|---|---|---|
| 5,613,135 | A * | 3/1997 | Sakai et al. | 710/62 |
| 7,173,813 | B2 * | 2/2007 | Wu | 361/679.08 |
| 7,506,152 | B2 * | 3/2009 | Park et al. | 713/100 |
| 2004/0204183 | A1 * | 10/2004 | Lencevicius et al. | 455/574 |
| 2005/0201095 | A1 * | 9/2005 | Brase et al. | 362/276 |
| 2009/0058887 | A1 * | 3/2009 | Lin | 345/690 |
| 2009/0158221 | A1 * | 6/2009 | Nielsen et al. | 715/867 |
| 2009/0262052 | A1 * | 10/2009 | Yang | 345/84 |
| 2010/0165147 | A1 * | 7/2010 | Tabata | 348/231.99 |
| 2011/0298985 | A1 * | 12/2011 | Wang et al. | 348/673 |

FOREIGN PATENT DOCUMENTS

| | | |
|---|---|---|
| CN | 101382909 | 3/2009 |
| CN | 101714346 | 5/2010 |
| CN | 101783133 A | 7/2010 |
| TW | 200615901 A | 5/2006 |
| TW | 201030728 A | 8/2010 |

OTHER PUBLICATIONS

Taiwan Office Action dated Oct. 25, 2013.

English translation of abstract of CN 101783133 A (published Jul. 21, 2010).

English translation of abstract of TW 200615901 A (published May 16, 2006).

English translation of abstract of TW 201030728 A (published Aug. 16, 2010).

* cited by examiner

*Primary Examiner* — Jimmy H Nguyen

(74) *Attorney, Agent, or Firm* — McClure, Qualey & Rodack, LLP

(57) ABSTRACT

A displaying method used in a portable electronic device is provided. The portable electronic device includes a display panel having a backlight module. The displaying method includes the following steps: turning off the backlight module when a rotation event occurs; waiting for a time period; turning on the backlight module.

16 Claims, 10 Drawing Sheets

DISPLAYING METHOD AND PORTABLE ELECTRONIC DEVICE USING THE SAME

CROSS-REFERENCE TO RELATED APPLICATIONS

This Non-provisional application claims priority under 35 U.S.C. §119(a) on Patent Application No(s). 099132106 filed in Taiwan, Republic of China on Sep. 21, 2010, the entire contents of which are hereby incorporated by reference.

BACKGROUND OF THE INVENTION

1. Field of the Invention

This invention relates to a displaying method and, more particularly, to a displaying method used in a portable electronic device.

2. Description of the Related Art

At present, a portable electronic device plays an important role in people's daily life. A tablet computer, a smart phone, a personal digital assistant, or a portable navigation device facilitates people's life. A user can access Internet, send and receive e-mails, search data, watch TV programs, play games, see films, or browse photos via the portable electronic device anytime.

Besides easy carry, the portable electronic device can be used horizontally or vertically according to habits of the user thus to be adjusted to an angle for more convenient use to satisfy different application needs.

FIG. 1 is a schematic diagram showing frame sticking when a conventional portable electronic device is rotated. At present, when a conventional portable electronic device 1 using a Windows operating system is switched between a horizontal state and a vertical state, a frame 12 may stick. In detail, an image originally seen by the user may be rotated first (such as the upper portion 121 in FIG. 1). However, since the hardware efficiency of the portable electronic device 1 is limited, the frame 12 may fail to be re-arranged to be adjusted to a vertical one, and therefore the lower portion 122 may remain un-displayed. Accordingly, visual segmentation may be felt by the user, thus deteriorating comfort in operation.

BRIEF SUMMARY OF THE INVENTION

One objective of the invention is to provide a displaying method and a portable electronic device using the same to improve the frame sticking or mosaic phenomenon due to limited hardware efficiency of the portable electronic device when rotation occurs and further to eliminate feelings of visual segmentation or discomfort in operation.

A displaying method according to one embodiment of the invention is used in a portable electronic device. The portable electronic device includes a display panel having a backlight module. The displaying method includes the following steps: turning off the backlight module when a rotation event occurs; waiting for a time period; turning on the backlight module.

In one embodiment, the displaying method may further include a step of dimming the display panel gradually before turning off the backlight module.

In one embodiment, the displaying method may further include steps of storing a brightness value of the display panel before dimming the display panel gradually and lighting the display panel gradually to the brightness value after turning on the backlight module.

In one embodiment, the displaying method may further include a step of lighting the display panel gradually after turning on the backlight module.

In one embodiment, the portable electronic device may further include a basic input/output system (BIOS), and the displaying method may further include steps of receiving a rotation signal by the BIOS and sending the rotation event by the BIOS after the rotation signal is received.

In one embodiment, the portable electronic device may further include a storage device for storing a resident program, and the steps of turning off the backlight module, waiting for the time period, and turning on the backlight module may be achieved by executing the resident program.

In one embodiment, the portable electronic device may further include an embedded controller, and in the step of turning off the backlight module, the backlight module may be turned off by the embedded controller.

In one embodiment, the portable electronic device may further include an embedded controller, and in the step of turning on the backlight module, the backlight module may be turned on by the embedded controller.

In one embodiment, the time period may be a predetermined time period.

The invention further provides a portable electronic device including a display panel and a control means. The display panel has a backlight module. The control means is used for controlling the backlight module. When a rotation event occurs at the portable electronic device, the control means turns off the backlight module and turns on the backlight module after waiting for a time period.

In one embodiment, the portable electronic device may further include a rotation sensing unit for sensing rotation of the portable electronic device thus to send a rotation signal. The portable electronic device may further include a BIOS for receiving the rotation signal and sending the rotation event after receiving the rotation signal.

In one embodiment, the control means may include a storage device, such as a flash memory, for storing a resident program. When the rotation event occurs at the portable electronic device, the resident program may be executed to turn off the backlight module and to turn on the backlight module after waiting for the time period.

In one embodiment, the control means may include an embedded controller for turning off and turning on the backlight module.

In one embodiment, the time period may be a predetermined time period.

According to the displaying method and the portable electronic device using the same, the user may not directly feel the frame sticking by turning off the backlight module when rotation occurs. After a time period, after the frame is re-arranged, the backlight module is turned on again, and thus the frame after rotation is displayed. Accordingly, even if the hardware efficiency is limited thus to fail to synchronously process images when rotation occurs, according to the method in the invention, the user can be free from the interference of the frame sticking or mosaic phenomenon, thus eliminating the uncomfortable feeling.

Compared with the prior art, the method according to the invention is so economic that no additional component is needed, and therefore the cost is saved and portability of the device is maintained. Further, a special transition effect can be obtained via fade in and fade out before turning off and after turning on the backlight module, thus allowing the user to more naturally enjoy the image processing procedure when rotation occurs.

These and other features, aspects, and advantages of the present invention will become better understood with regard to the following description, appended claims, and accompanying drawings.

DETAILED DESCRIPTION OF THE INVENTION

A displaying method and a portable electronic device using the same according to preferred embodiments of the invention may be described with related drawings. The portable electronic device includes a display panel having a backlight module. The same element may be described with the same reference number hereinbelow.

The portable electronic device according to the invention or the portable electronic device where the method according to the invention is used may be a tablet computer, a smart phone, a personal digital assistant, or a portable navigation device. Preferably, the portable electronic device in the embodiment may be a tablet computer.

Figure 1:
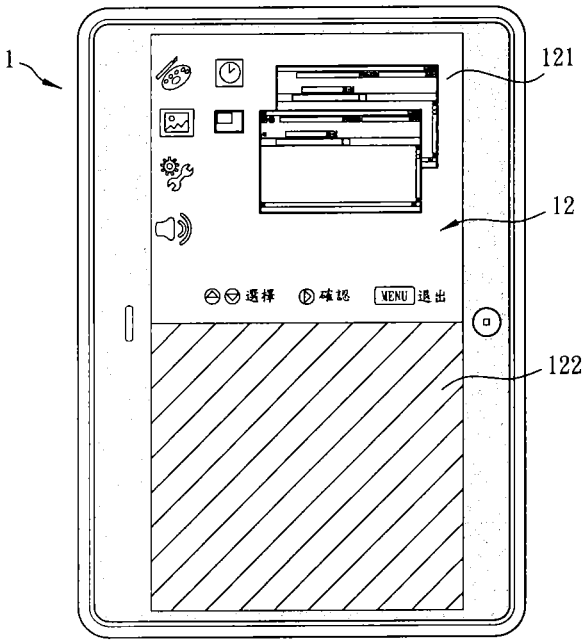
FIG. 1 is a schematic diagram showing frame sticking when a conventional portable electronic device is rotated.
Figure 2:
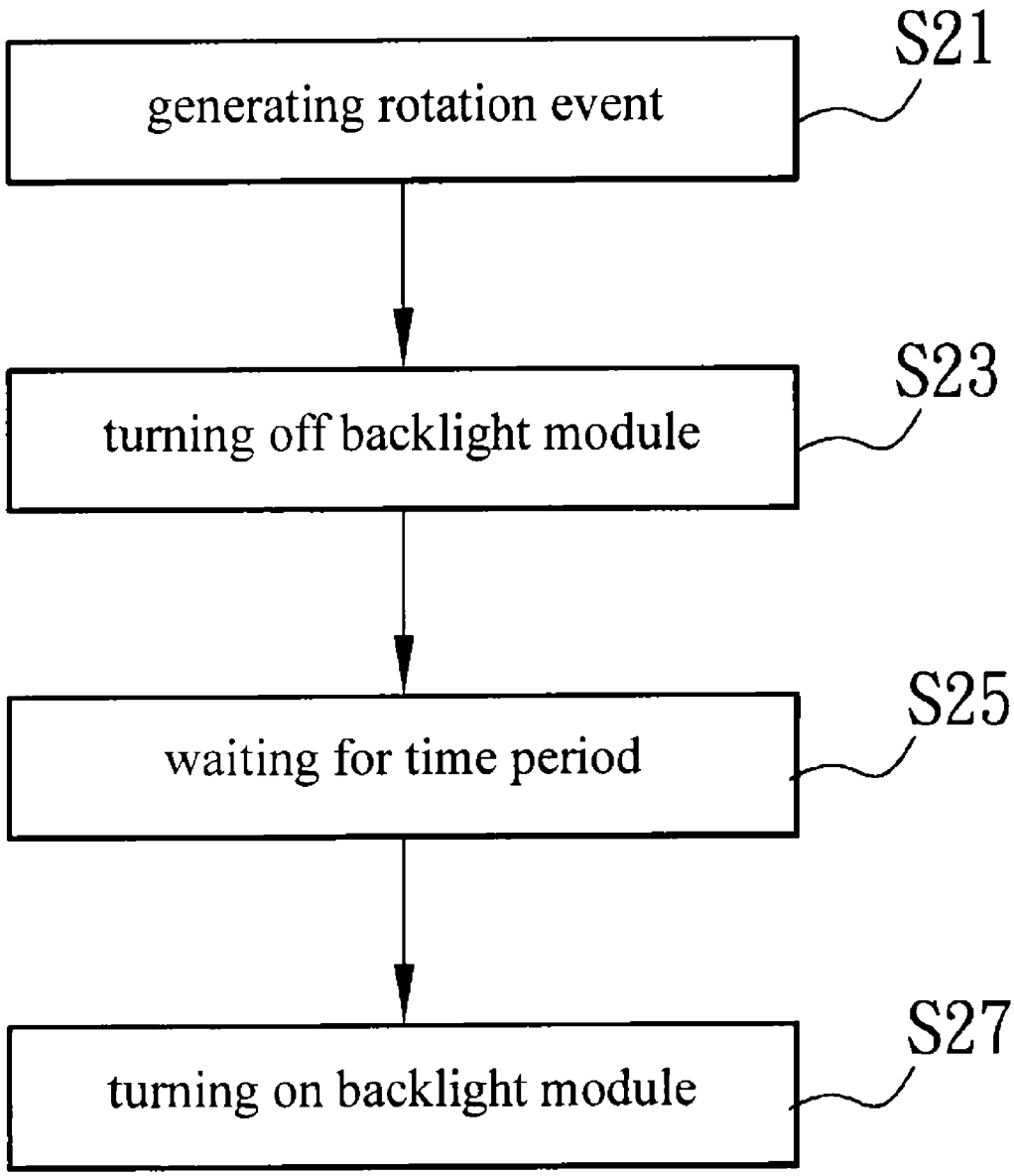
FIG. 2 is a flow chart showing a displaying method according to a first embodiment of the invention.

FIG. 2 is a flow chart showing a displaying method according to a first embodiment of the invention. In FIG. 2, the displaying method includes the following steps: generating a rotation event (step S21); turning off a backlight module (step S23); waiting for a time period (step S25); turning on the backlight module (step S27).

Since the displaying method aforementioned is used in a portable electronic device, it may be described with the portable electronic device and the elements thereof hereinbelow.

Figure 3A:
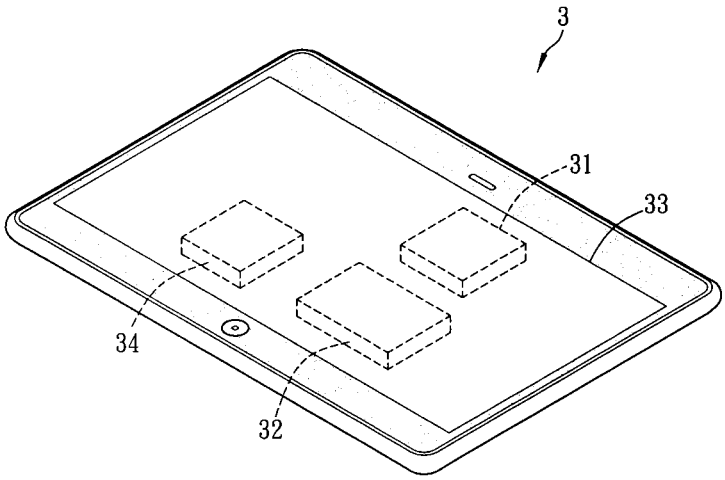
FIG. 3A is a schematic diagram showing a portable electronic device where the displaying method according to the first embodiment of the invention is used.
Figure 3B:
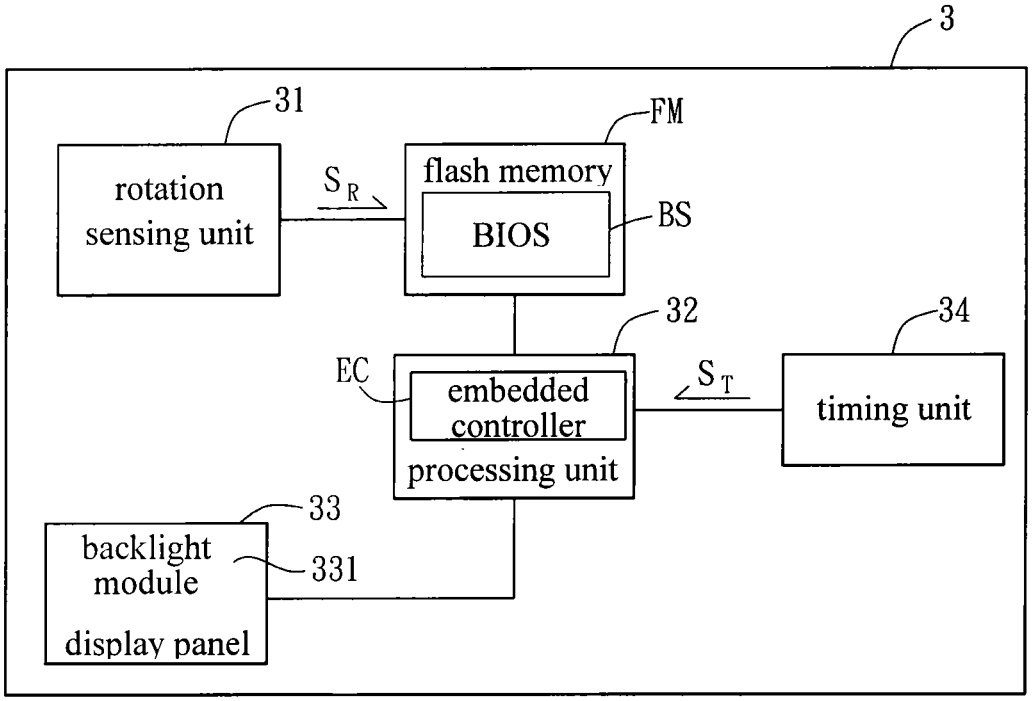
FIG. 3B is a system block diagram showing the portable electronic device in FIG. 3A.

FIG. 3A is a schematic diagram showing a portable electronic device where the displaying method according to the first embodiment of the invention is used, and FIG. 3B is a system block diagram showing the portable electronic device in FIG. 3A. In FIG. 3A, the portable electronic device 3 may include a rotation sensing unit 31, a processing unit 32, a display panel 33, a timing unit 34, and a flash memory FM. The processing unit 32 includes an embedded controller EC. The display panel 33 has a backlight module 331. The flash memory FM stores a BIOS BS. In FIG. 3B, the rotation sensing unit 31, the display panel 33, the timing unit 34, and the flash memory FM are coupled to the processing unit 32, and preferably they are electrically connected with the processing unit 32 to send signals.

The rotation sensing unit 31 is used for sensing rotation of the portable electronic device 3. The rotation sensing unit 31 may be a gyroscope, a three-axis accelerometer, or a combination thereof. The processing unit 32 is used for turning off or turning on the backlight module. The display panel 33 may be a touch display panel. Although the BIOS BS is stored in the flash memory FM in the embodiment, in other embodiments of the invention, it can be stored in the form of other firmware. The invention is not limited thereto.

Here please refer to FIG. 3B together. In step S21, when the portable electronic device 3 is to be rotated from the horizontal state in FIG. 4 which is a schematic diagram showing a displayed frame when the portable electronic device in FIG. 3A is used horizontally to the vertical state, a body can be rotated 90 degrees to allow the rotation sensing unit 31 to sense the rotation of the portable electronic device 3 thus to send a rotation signal $S_R$ to the BIOS BS which may be in the flash memory FM. After the BIOS BS receives the rotation signal $S_R$, it sends a rotation event. After the BIOS BS sends the rotation event, the portable electronic device 3 executes a resident program stored in the storage device and resident in the operating system.

The resident program may send a corresponding signal or instruction to execute the displaying method according to the embodiment. Certainly, in other embodiments of the invention, when the rotation event occurs, different applications may be executed to output corresponding signals or instructions, respectively.

In the embodiment, the resident program controls the embedded controller EC of the processing unit 32 to turn off the backlight module 331 of the display panel 33, thus allowing the display panel 33 not to light. Accordingly, the user may fail to see the images which should be output at that moment. In a word, in step S23, the embedded controller EC turns off the backlight module 331 of the portable electronic device 3.

In the embodiment, when the rotation event occurs, the displayed frame of the display panel of the portable electronic device should be rotated. However, due to the limitation of the volume and weight of the portable electronic device 3, the hardware efficiency is usually limited. Especially, a high-level hardware has to be needed to draw, and therefore the image processing may fail to be finished immediately, thus generating the frame sticking or mosaic phenomenon.

Figure 4:
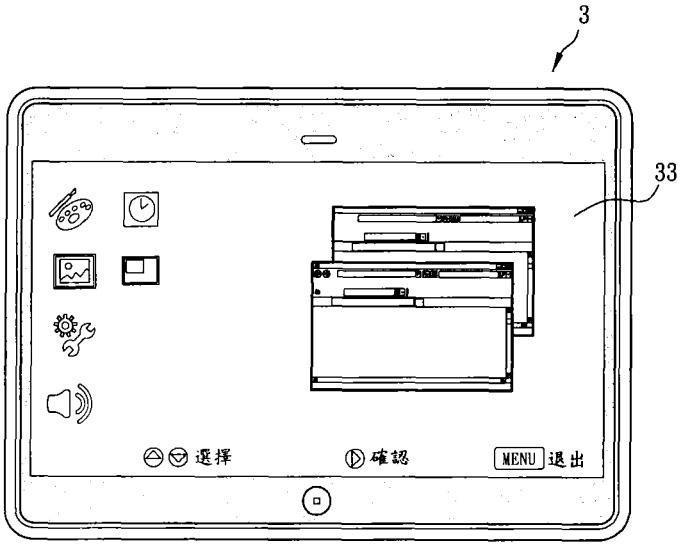
FIG. 4 is a schematic diagram showing a displayed frame when the portable electronic device in FIG. 3A is used horizontally.
Figure 5:
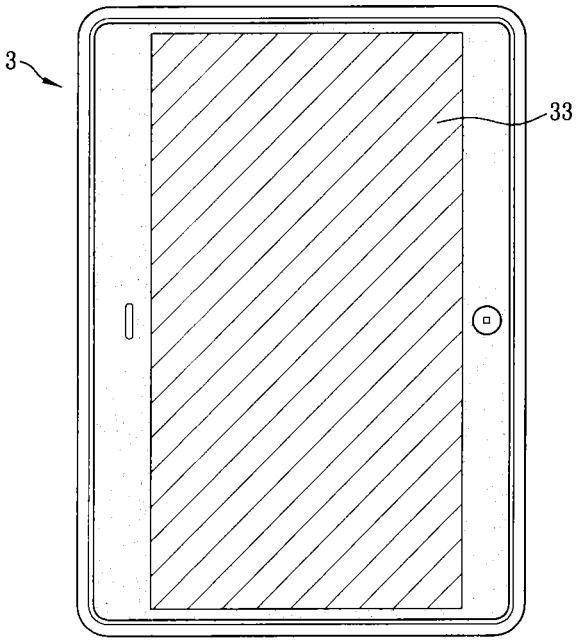
FIG. 5 is a schematic diagram showing a displayed frame when the portable electronic device in FIG. 4 is switched to a vertical state and a backlight module is turned off.

However, since the backlight module 331 is turned off according to the displaying method in the embodiment, as shown in FIG. 5 which is a schematic diagram showing a displayed frame when the portable electronic device in FIG. 4 is switched to a vertical state and a backlight module is turned off, no images are displayed on the portable electronic device 3. Accordingly, the user may not suffer discomfort.

In step S25, after the backlight module 331 is turned off, the portable electronic device 3 waits for a time period. In detail, once receiving the signal or the instruction from the resident program, according to a default or a user-predetermined time period, the processing unit 32 can control the timing of the timing unit 34 and control the backlight module 331 to maintain the turning-off state in the time period. Certainly, the timing method is not limited to forward timing or reverse timing. The time period may preferably be the default value such as 1.5 seconds. However, in the invention, the value of the time period is not specially limited, and preferably it may cooperate with the image rotation processing time. In other words, when the image rotation processing is finished, the time period is just over, thus avoiding generating too many differences.

Figure 6:
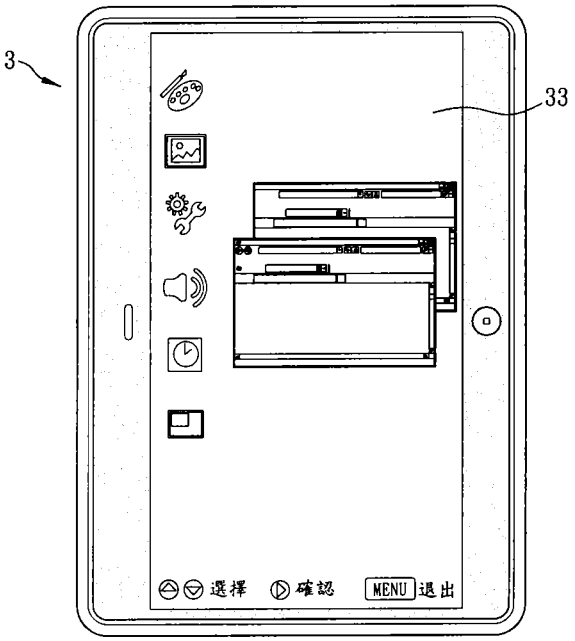
FIG. 6 is a schematic diagram showing a displayed frame when the portable electronic device in FIG. 4 is switched to the vertical state and image rotation processing is finished.

In step S27, after the time period, the timing unit 34 outputs a timing signal $S_T$ to the processing unit 32, and then the resident program controls the embedded controller EC of the processing unit 32 to turn on the backlight module 331 of the display panel 33 in the portable electronic device 3. As shown in FIG. 6 which is a schematic diagram showing a displayed frame when the portable electronic device in FIG. 4 is switched to the vertical state and image rotation processing is finished, since the image rotation processing is finished, the output images are suitably used as a vertical frame after adjustment.

Accordingly, in the displaying method used in the portable electronic device, the backlight module can be turned off by sensing the rotation, and therefore even if the hardware efficiency of the portable electronic device is limited, the user can be free from the interference of the frame sticking or mosaic phenomenon, thus eliminating the uncomfortable feeling.

Figure 7:
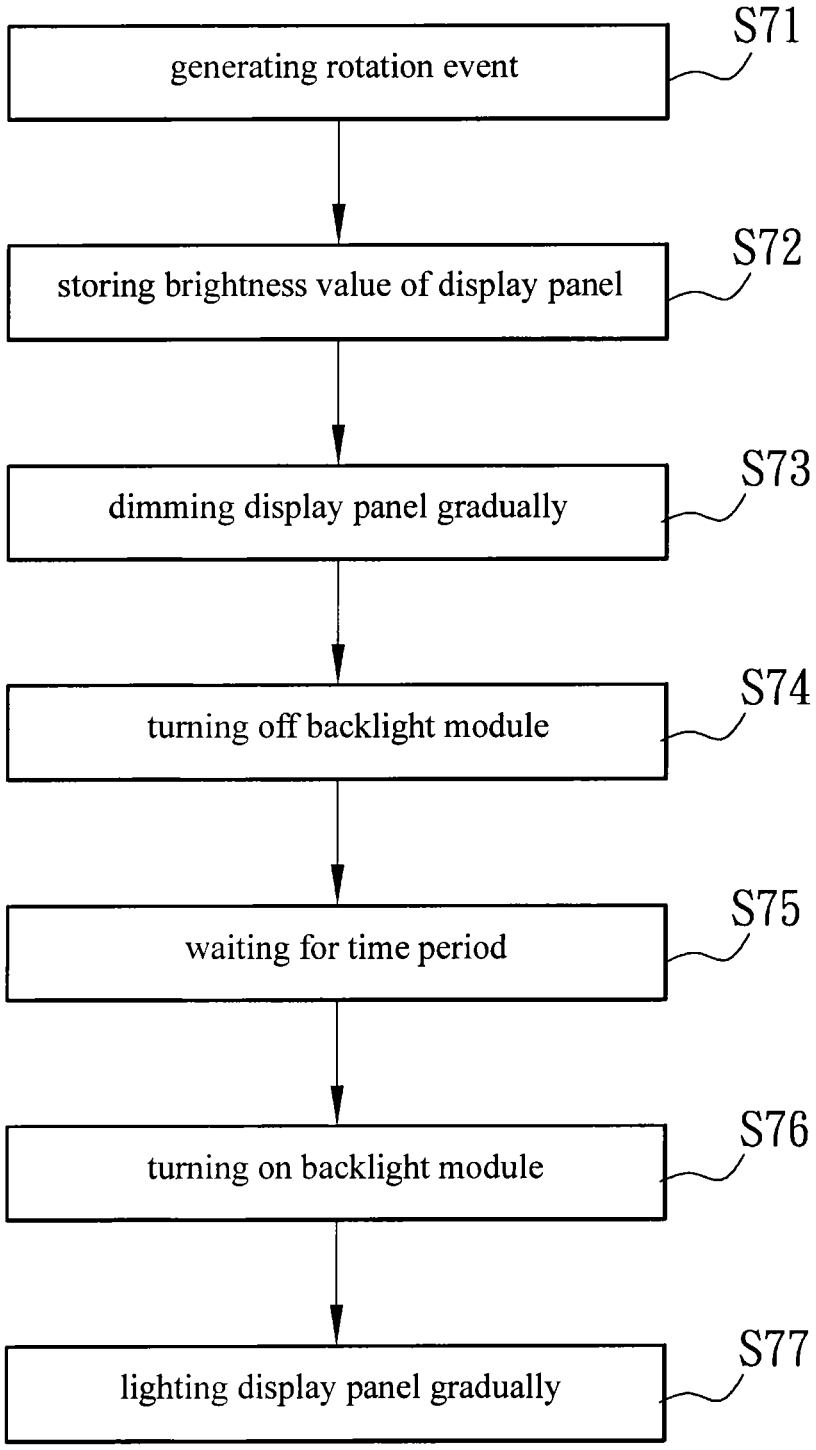
FIG. 7 is a flow chart showing a displaying method according to a second embodiment of the invention.

FIG. 7 is a flow chart showing a displaying method according to a second embodiment of the invention. The displaying method in FIG. 7 is similar to that in the first embodiment. Differently, the displaying method in the second embodiment further includes the following three steps: storing a brightness value of the display panel (step S72); dimming the display panel gradually (step S73); lighting the display panel gradually (step S77). Step S72 is executed before dimming the display panel gradually; step S73 is executed before turning off the backlight module; step S77 is executed after turning on the backlight module.

Since steps S71, S74, S75, and S76 are the same to steps S21, S23, S25, and S27, respectively, they are not described for concise purpose. Steps S72, S73, and S77 may be described hereinbelow.

In step S72, the brightness value of the display panel may be stored in the storage device of the portable electronic device according to the corresponding signal or instruction output by the resident program before turning off the backlight module. In detail, a brightness application stored in the storage device may be called according to the signal or instruction output after the resident program receives the rotation event. Afterward the brightness application determines and records the current brightness value of the display panel. In detail, since most portable electronic devices adopt a Windows operating system providing an interface for controlling a brightness value, the aforementioned brightness application only needs to record the corresponding value. Preferably, for quick response, the brightness application may also be resident in the operating system.

Figure 8:
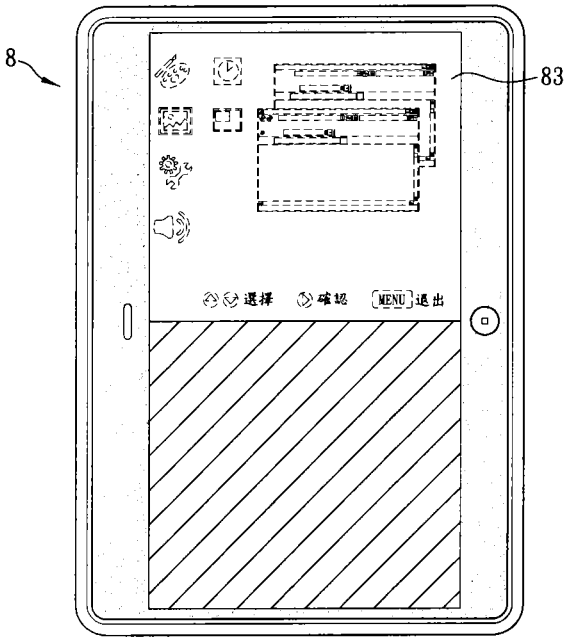
FIG. 8 is a schematic diagram showing a displayed frame when a display panel of a portable electronic device where the displaying method according to the second embodiment of the invention is used is dimmed gradually.

FIG. 8 is a schematic diagram showing a displayed frame when a display panel of a portable electronic device where the displaying method according to the second embodiment of the invention is used is dimmed gradually. Please refer to FIG. 8 together. In step S73, after the brightness value is stored by the portable electronic device 8 via the aforementioned brightness application and before the backlight module is turned off, the processing unit can dim the display panel 83 gradually according to the signal or instruction from the resident program. Preferably, the processing unit adopts the same brightness application to adjust the brightness value directly via the interface provided by the operating system. However, the invention is not limited thereto. In the embodiment, gradual dimming means dimming the display panel 83 as time goes on till the user fails to see the displayed frame. Certainly, the display panel 83 can be dimmed to the lowest brightness value. However, the invention is not limited thereto. It can be adjusted according to the actual environment or element conditions. Further, dimming the display panel is different from turning off the backlight module. Afterimages may exist after dimming the display panel, thus failing to make the user fail to see any frame. The word "gradually" preferably means that variation of the brightness per unit time is the same. However, the invention is not limited thereto.

Further, the display panel 83 of the portable electronic device 8 begins be dimmed once the rotation occurs. Although the frame which should be displayed when the portable electronic device 8 is rotated to the vertical state is similar to that in prior art, actually the brightness makes the user hard to recognize the frame. Further, since the backlight module is turned off afterward, the user may not suffer discomfort, which is different from the prior art.

The processing unit can wait for another time period before or when or after dimming the display panel 83 of the portable electronic device 8. The time when the two actions are executed may be different while they are quite close. In the embodiment, the time period preferably cooperate with the velocity of dimming the display panel 83. For example, the time period may be the default value pre-determined when production. In detail, the display panel 83 begins to be dimmed gradually at the beginning of the time period, and it can be dimmed to the lowest brightness value at the end of the time period. However, the invention is not limited thereto. Others related to the time period are the same to that aforementioned, and therefore they are not described for concise purpose.

Figure 9:
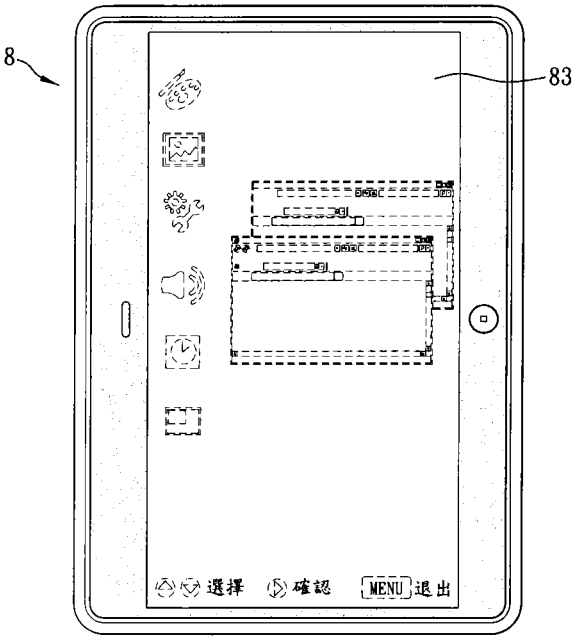
FIG. 9 is a schematic diagram showing a displayed frame when the portable electronic device where the displaying method according to the second embodiment of the invention is used is lighted gradually.

In step S77, after the processing unit turns on the backlight module, the display panel 83 of the portable electronic device 8 is lighted gradually. FIG. 9 is a schematic diagram showing a displayed frame when the portable electronic device where the displaying method according to the second embodiment of the invention is used is lighted gradually. The control method for lighting the display panel 83 is basically the same to that for dimming the display panel 83 in step S73, and therefore it is not described for concise purpose. Preferably, in the embodiment, the brightness application controls the display panel 83 to be restored to the original brightness value, thus avoiding generating difference.

Further, the preferred embodiment of the invention provides a portable electronic device corresponding to the aforementioned method. The portable electronic device is described as above in detail, and therefore it is not descried for concise purpose.

To sum up, according to the displaying method and the portable electronic device using the same, the user may not directly feel the frame sticking by turning off the backlight module when rotation occurs. After a time period, after the frame is re-arranged, the backlight module is turned on again, and thus the frame after rotation is displayed. Accordingly, even if the hardware efficiency is limited thus to fail to synchronously process images when rotation occurs, according to the method in the invention, the user can be free from the interference of the frame sticking or mosaic phenomenon, thus eliminating the uncomfortable feeling.

Compared with the prior art, the method according to the invention is so economic that no additional component is needed, and therefore the cost is saved and portability of the device is maintained. Further, a special transition effect can be obtained via fade in and fade out before turning off and after turning on the backlight module, thus allowing the user to more naturally enjoy the image processing procedure when rotation occurs.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A displaying method used in a portable electronic device including a display panel having a backlight module, the displaying method comprising the following steps of:

displaying a first image on the display panel;

sensing a rotation event of the portable electronic device;

turning off the backlight module solely in response to the rotation event, wherein the backlight module is turned off during a duration of the rotation event;

waiting for a time period immediately following a cessation of the rotation event; and turning on the backlight module to cause the display panel to display a second image generated by rotating the first image with respect to the display panel, after the time period has lapsed.

2. The displaying method according to claim 1, further comprising a step of:

dimming the display panel gradually before turning off the backlight module.

3. The displaying method according to claim 2, further comprising steps of:

storing a brightness value of the display panel before dimming the display panel gradually; and lighting the display panel gradually to the brightness value after turning on the backlight module.

4. The displaying method according to claim 1, further comprising a step of:

lighting the display panel gradually after turning on the backlight module.

5. The displaying method according to claim 1, wherein the portable electronic device further comprises a basic input/output system (BIOS), and the displaying method further comprises steps of:

receiving a rotation signal by the BIOS; and sending the rotation event by the BIOS after the rotation signal is received.

6. The displaying method according to claim 1, wherein the portable electronic device further comprises a storage device for storing a resident program, and the steps of turning off the backlight module, waiting for the time period, and turning on the backlight module are achieved by executing the resident program.

7. The displaying method according to claim 1, wherein the portable electronic device further comprises an embedded controller, and in the step of turning off the backlight module, the backlight module is turned off by the embedded controller.

8. The displaying method according to claim 1, wherein the portable electronic device further comprises an embedded controller, and in the step of turning on the backlight module, the backlight module is turned on by the embedded controller.

9. The displaying method according to claim 1, wherein the time period is a predetermined time period.

10. A portable electronic device comprising:

a display panel having a backlight module and displaying a first image; and a control means for controlling the backlight module, wherein during a rotation event of the portable electronic device occurs, and solely in response to the rotation event, the control means turns off the backlight module and turns on the backlight module to cause the display panel to display a second image generated by rotating the first image with respect to the display panel, after waiting for a time period immediately following a cessation of the rotation event.

11. The portable electronic device according to claim 10, further comprising a rotation sensing unit for sensing rotation of the portable electronic device thus to send a rotation signal.

12. The portable electronic device according to claim 11, further comprising a BIOS for receiving the rotation signal and sending the rotation event after receiving the rotation signal.

13. The portable electronic device according to claim 10, wherein the control means comprises a storage device for storing a resident program, and when the rotation event occurs at the portable electronic device, the resident program is executed to turn off the backlight module and to turn on the backlight module after waiting for the time period.

14. The portable electronic device according to claim 10, wherein the control means comprises an embedded controller for turning off and turning on the backlight module.

15. The portable electronic device according to claim 10, wherein the time period is a predetermined time period.

16. A displaying method used in a portable electronic device including a display panel having a backlight module, the displaying method comprising the following steps of:

displaying a first image on the display panel;

sensing a rotation event of the portable electronic device sufficient to warrant a rotation of the first image with respect to the display panel;

turning off the backlight module solely in response to the sensed rotation event, wherein the backlight module is turned off during a duration of the rotation event; and turning on the backlight module to cause the display panel to display a second image generated by rotating the first image with respect to the display panel, after waiting for a time period immediately following a cessation of the rotation event.

* * * * *